US006908065B1

(12) United States Patent
Ritchie

(10) Patent No.: US 6,908,065 B1
(45) Date of Patent: Jun. 21, 2005

(54) 3-DIMENSIONAL BEAD PROCESS

(76) Inventor: Gregory Ritchie, 652 Elba Ave., Mobile, AL (US) 36612

( * ) Notice: Subject to any disclaimer, the term of this patent is extended or adjusted under 35 U.S.C. 154(b) by 142 days.

(21) Appl. No.: 10/449,376

(22) Filed: May 30, 2003

Related U.S. Application Data

(60) Provisional application No. 60/384,667, filed on May 30, 2002.

(51) Int. Cl.[7] ..... B21F 27/00

(52) U.S. Cl. ..... 245/1; 245/3; 245/4; 245/5; 140/92; 59/83; 63/4; 428/592

(58) Field of Search ..... 245/1, 3–5; 140/3, 140/92, 88; 59/80, 83; 63/4; 428/592

(56) References Cited

U.S. PATENT DOCUMENTS

| | | | | | |
|---|---|---|---|---|---|
| 2,298,591 | A | * | 10/1942 | Ross | 59/80 |
| 2,589,260 | A | * | 3/1952 | Jablon | 70/457 |
| 2,681,545 | A | * | 6/1954 | Hall | 59/80 |
| 2,737,046 | A | * | 3/1956 | Jancsics | 70/457 |
| 3,385,050 | A | * | 5/1968 | Hall | 59/78 |
| 3,386,240 | A | * | 6/1968 | Blumstein | 59/78 |
| 3,733,852 | A | * | 5/1973 | Johnson et al. | 63/37 |
| 4,448,017 | A | * | 5/1984 | Stark | 59/80 |
| 5,018,250 | A | * | 5/1991 | Schroder | 24/116 A |
| 5,592,835 | A | * | 1/1997 | Herr | 63/4 |
| 5,664,410 | A | * | 9/1997 | Nydick | 59/80 |
| 6,220,010 | B1 | * | 4/2001 | Gomez | 59/80 |
| 6,462,250 | B1 | | 10/2002 | Kuriyama et al. | 588/204 |
| 6,532,725 | B1 | * | 3/2003 | Chia et al. | 59/35.1 |
| 2002/0036174 | A1 | | 3/2002 | Kawaguichi et al. | 210/748 |
| 2002/0130030 | A1 | | 9/2002 | Kato et al. | 204/157.15 |

FOREIGN PATENT DOCUMENTS

| | | |
|---|---|---|
| JP | 62-191025 | 8/1987 |
| JP | 62-191095 | 8/1987 |

* cited by examiner

*Primary Examiner*—John J. Calvert
*Assistant Examiner*—Robert H Muromoto

(57) ABSTRACT

A method for weaving beads together in order to form a textured chamber comprised of woven strings of beads and products generated thereby is shown. A plurality of bead strings, referred to herein as chains, are used which are comprised of beads connected by strings. Each bead has spacing corresponding to and functionally working with the spacing of the joining strands of string. There is near identity as far as bead spacing and bead size in the preferred embodiment between the multiple hanging chains and the single locking chain of beads. Two to three beads of each hanging chain are skipped, while preferably each bead after one or more initial strands of the locking chain are used in order to form a structure which has flexibility but strong contact. When multiple (three or more) separate chains are inter-woven with appropriate spacing, then the resulting structure is expanded outward to form a tube. This tube can be maintained by proper spacing and by locking the beads at either end. The application of sufficient pressure to unlock the locking chain from the other chains can be increased using other locking techniques such as melting or glueing the beads together.

19 Claims, 5 Drawing Sheets

3-DIMENSIONAL BEAD PROCESS

PRIORITY STATEMENT

The present patent is a continuation in part of provisional patent 60/384,667 filed May 30, 2002. This patent claims priority on Provisional Patent 60/384,667 filed May 30, 2002.

BACKGROUND OF INVENTION

1. Field of Invention

The present invention relates to beads. More specifically the present invention pertains to a method for weaving beads together in order to form a textured chamber comprised of woven strings of beads and products derived therefrom.

2. Prior Art

Beads and woven strands are known in the prior art. The structure of bead strings used in making weaves is not taught. See U.S. Pat. Nos. 5,219,624, 3,708,862, 5,426,843 and 6,149,437.

GENERAL DISCUSSION OF THE INVENTION

It can best be seen by reference to FIG. 1 in the preferred embodiment the invention has a plurality of bead strings, which are comprised of beads connected by strings. Each bead has spacing corresponding to and functionally working with the spacing of the joining strands between beads.

In the preferred embodiment, there is an identity as far as bead spacing and bead size between the hanging bead chains and the locking bead string of the locking chain. It can be seen by the description which follows that this may not be the case in all circumstances.

The interlocking of one bead string with another provides no particular novel affect. When multiple (three or more) separate strands are inter-woven with appropriate spacing, then the resulting structure is expanded outward to form a tube. This tube can be maintained proper spacing and by locking the beads at either end. The application of sufficient pressure to unlock the locking bead strand from the other beads can be increased using other locking techniques such as melting or glueing adjacent beads together.

An additional improvement is to utilize the space within the tube to hold either one or more interlocking bead strands, a single strand of beads, a glow in the dark lighting means, or a stuffed animal or other flexible item, in order to get additional utility and additional structure from the primary structures created by this novel weaving and connecting process.

In one version, the color of the beads would be identical. In another version the color and size would vary in accordance with the locking bead chain being of one color and the other chains being of different colors in order to get different effects. Sports team or other group colors could be achieved in this way in woven strands.

In some circumstances, the weaving of one or more of the colors might be done with either beads or a string of flourescent or other glowing means incorporated therein in order to highlight the three-dimensional structure. A glow in the dark member means may be inserted therein, either at specific points or as a continuous strand running the length of the beads.

All of the strands together are locked on either end with some sort of fixing means such as by melting them or glueing them together or otherwise fixing them with a clasp of some sort in order to assist in maintaining the shape. The two ends may be connected to form a necklace or choker.

1. A method is there described of making cylindrical chambers having a framework of beads and strands from at least three chains comprising a locking chain and at least two hanging chains; each of said chains comprised of a plurality of beads separated by spaces defined by the inter-spacial strands along the chain of a length less than the diameter of the beads comprising the steps of:

A. weaving the locking chain of beads sequentially in contact with each of the at least two hanging chains;

B. repeating step A until the desired length as obtained. The method 1 further comprises locking the first beads of each chain together where the chamber begins and the last beads of the chamber to provide stability.

Weaving comprises frictionally locking at least a second plurality of the beads of the locking chain to at least a second plurality of the beads in the hanging strand and maintaining tension in the weave on the locking chain. Maintaining tension comprises skipping at least two strands on the hanging chains and skipping at least one less strand on the connecting chain.

Locking consists attaching across every strand of the locking chain and at no more than every other strand of the hanging chains. In the preferred embodiment, locking comprises attaching across every third strand of the hanging chains which allows the beads in the hanging chains to make subtle arcs which are flexible because the strands are flexible.

At least one object may be partially or fully inserted within the chamber formed by the weave.

The weave comprises front beads and last beads and the step of connecting typically involves connecting the first beads to the last beads to form a loop. In other embodiments, the chains forming a chamber are attached to an object to decorate the object. The product can be described as at least one locking bead chain comprised of a plurality of beads connected by strands; a plurality of hanging chains comprised of a plurality of beads connected by strands; a connecting means for connecting a second plurality of beads in the locking chain to a second plurality of beads in the plurality of hanging chains.

There is a connecting means for sequentially connecting the locking chain to the plurality of hanging chains in a helix. The connecting means connects at least ten strands of the locking chain across at least ten strands of the at least three hanging chains. There is a chamber formed by the hanging chins and locking chain. The connecting means further comprises a frictional lock means which is preferably formed with the beads. A glue means may be used to further secure the frictional connecting means. This friction is maintained because the beads are wider in diameter than the strands and the friction lock is obtained by pressing beads on either side of the strand in the locking chain sequentially across a strand between two beads of a hanging chain and wherein each of the chains further comprises at least two beads on either side of the strand. Tension is applied across the locking chain by tightly attaching each strand of the locking chain across at least every other strand of the plurality of hanging chains.

It is therefore a purpose of this invention to provide a decorative bead strand from multiple separate strands or chains or strings of beads. It is a further purpose to provide novel containers from a process of bead construction. It is a further purpose to provide 3-D structure of beads to highlight items by attachment to items.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE PREFERRED EXEMPLARY EMBODIMENTS

Figure 2:
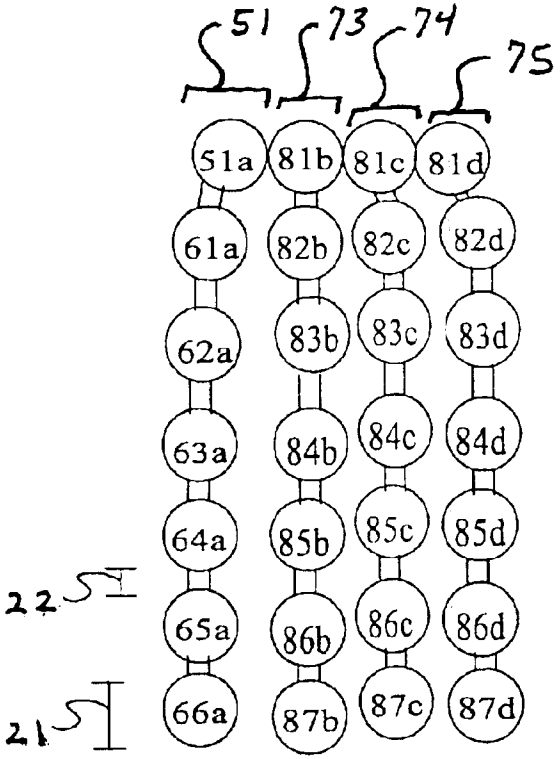
FIG. 2 shows the top 7 beads of four chains of beads prior to weaving.

In the preferred embodiment shown in FIG. 2 the distance of the strand between the bead in the locking chain 51, here first joining strand 1*a* shown between beads 61*a,* bead 62*a* and joining strand 1*b* between beads 82*a* and 83*b,* second hanging chain 74 and third joining strand 1*c* between beads 82*c* and 83*c* and fourth joining strand 1*d* between beads 82*d* and 83*d* of the third hanging chain is approximate 2 to 1 with beads having a diameter approximately two times (here two to four times) the length of the joining strand 1*a*. This may vary with the flexibility of the strand and bead. The diameter of the beads on the locking strand are spaced so that the strand length 22 between the locking beads (beads of chain 51) is approximately ½ to ¼ times the diameter 21 of the beads between which they fit so that a tight lock is formed when the chains of a locking chain and a hanging chain are connected together and the beads are interlocked as described below.

Figure 4:
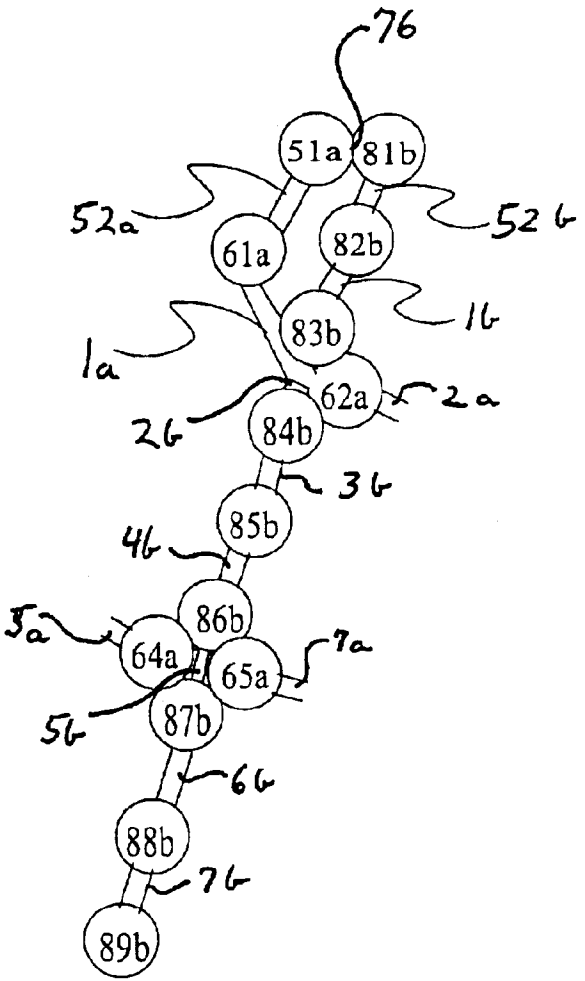
FIG. 4 shows a view of the single chain from FIG. 2 showing where the weaves would take place with the locking chain.
Figure 3:
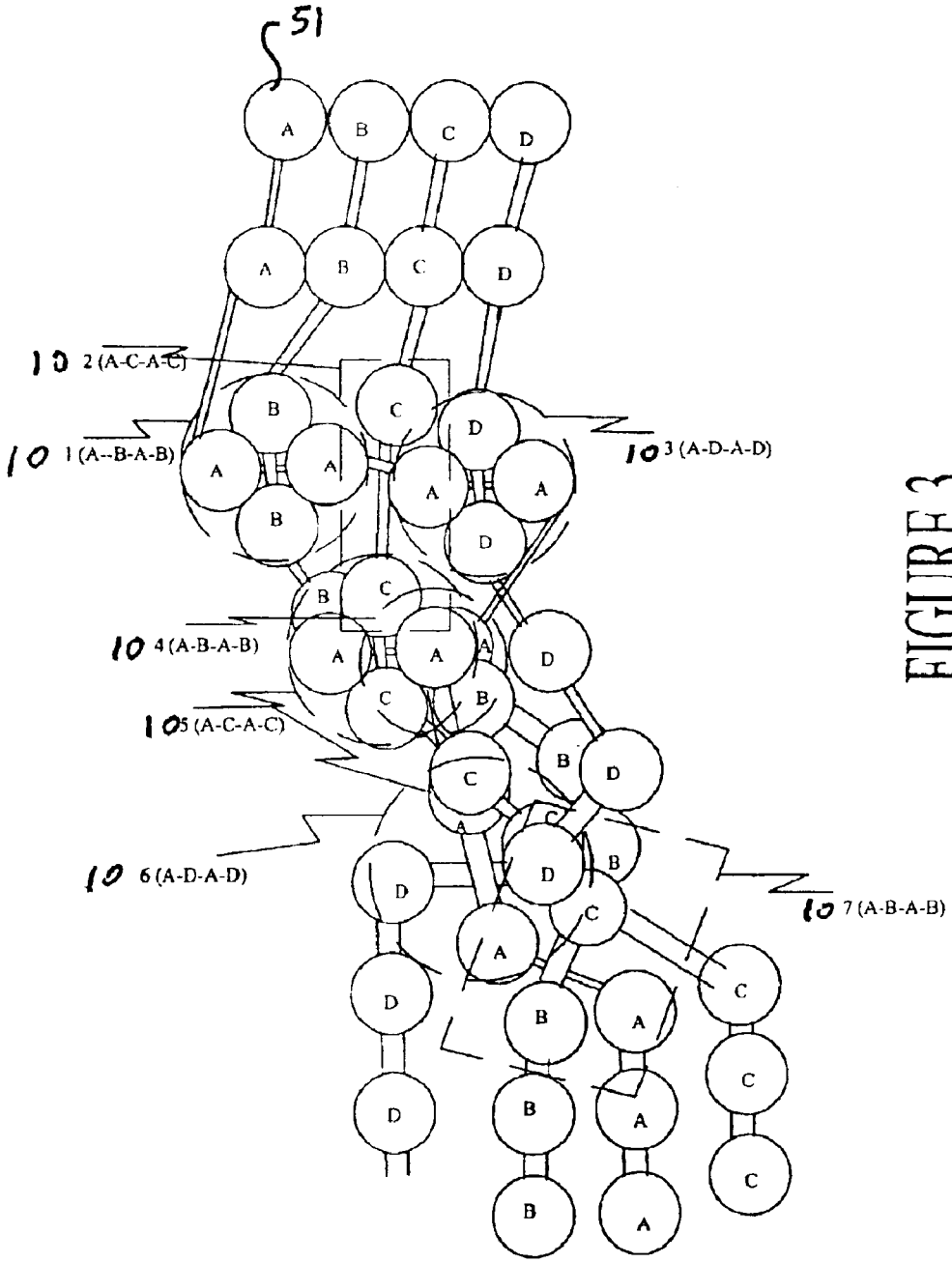
FIG. 3 shows the hanging chains from FIG. 2 woven with a locking strand.

Referring to FIGS. 2–4 it can be seen that there are four initial beads that may be glued at the top, melted together or otherwise joined which are here designated as 51*a,* 81*b,* 81*c.* and 81*d.* These beads are preferably joined at this location in order to tighten the structure which is formed by the process described herein with glue or weld 76. This same locking technique is used or the last 4 beads (not shown).

Each of the beads in a strand of beads (here called a chain or a string) held together by a strand of string to the following bead in the chain and these strands are designated 52*a,* 52*b,* 52*c,* 52*d,* etc., for the first section of string after each first bead 51*a,* 81*b,* 81*c* 81*d* of the four respectively. In practice, plastic bead chains fix plastic beads at approximately fixed locations along a continuous string.

Each bead is sequentially numbered so that the bead following 61*a* is 62*a* and the bead following 8l*b* is 82*b* the bead following 82*b* is 83*b* and the bead following 81*c* is 82*c* and the bead following 82*c* is 83*c* and the bead following 81*d* is 82*d* and the bead following 82*d* is 83*d* and so forth and so on.

All the lengths of connecting line are also sequentially numbered after the first one. The first strands 52*a,* 52*b,* 52*c,* and 52*d,* for each of the chains 51, 13, 14, and 15, respectively. The following strands are sequentially numbered 1*a,* 1*b,* 1*c,* and 1*d* for strands 51, 13, 14 and 15 respectively and then followed by 2*a,* 2*b,* 2*c,* and 2*d* respectively.

There is no specific length which the resulting chain (composite bead chain) need to be made and the only determining factor for how many beads are strung together lies in the determination of how long a composite bead chain is derived.

The other terminal end of the composite bead chain (a chain of all the individual bead chains) would be sealed in the same manner together in the preferred embodiment as the beginning end formed by the first beads 51*a,* 81*b,* 81*c* 81*d* as described herein.

The size of the bead and the length of the strand between the beads is a function of several factors. All the factors are designed in order to provide a means for interlocking the locking beads at the juncture between two hanging chain beads. The locking chain 51 is in the preferred embodiment, the only chain which is used to connect all the other chains together.

If any of the strands are elastic, and most strings have some elasticity to them, then the distance between the strand can vary allowing for a shorter or longer distance between the beads at any point in time during the construction process described below.

The key element is to provide that when the locking chain is placed against the hanging chain between any two beads on any hanging chain, the two beads on either side of the locking chain bead can be put opposite two beads on either side of the hanging chain joining strand so that this spacing and frictional contact (or an added weld in other embodiments) between the locking chain beads and the hanging chain beads maintains the positions so the beads and chains remain locked together.

The same locking can occur by using a locking means such as glue between beads or melting beads together although that is outside of the primary embodiment of the invention. Welding or melting to one extent or another defeats one of the major benefits of the invention which is to provide a structure of the type described herein without the need for excess materials and labor.

Every joining strand (of string) in the locking bead chain except for perhaps the very first one or two joining strands(is the figures only the first strand 52*a*) is preferably locked in this fashion to an joining strand of one of the hanging chains of beads. At least two beads in a standard bead chain with beads and strands in the ratio described herein are passed in the hanging chains.

The purpose of bypassing strands in the hanging chains is to provide an arch based on the pressure exerted by the close connection of the locking chain with the other hanging strands. This also gives flexibility to the structure which makes the structure more flexible and prevents it from collapsing easily.

By locking all the other strands together sequentially a loop is formed as the locking chain goes sequentially from one hanging chain to the next until it comes back to the first hanging chain. In the four chain set shown in FIG. 1, the locking chain first connects to the second inter-spacial space occupied by strand 1*b* between the beads in the hanging chain, then the second inter-spacial space (strand 1*c*) of the second hanging strand and then the third inter-spacial space (strand 1*d*) of the third hanging chain and then back to the fourth inter-spacial space of the first hanging strand and so on until beads are locked together in sufficient length in order to create a composite chain of interlocked beads to the desired length.

At this point in time, all of the beads are sealed together on the terminal end and the terminal end may be sealed permanently or detachably to the beginning end in order to form a loop or a necklace with a sealing means being a sealing means of the type known in the prior art by way of a clasp or melting the beads together or by glue or by other similar mechanisms.

In some embodiments, the 3-dimensional weave is attached as a decoration.

While this description utilizes a limited number of chains, in fact an infinite number of other chains can be used creating larger internal spaces but otherwise not affecting the structure or method.

FIGS. 2–4 shows with dotted lines the approximate location where each of the beads from the locking chain 51 will end up with at the end of the weaving process.

Figure 1:
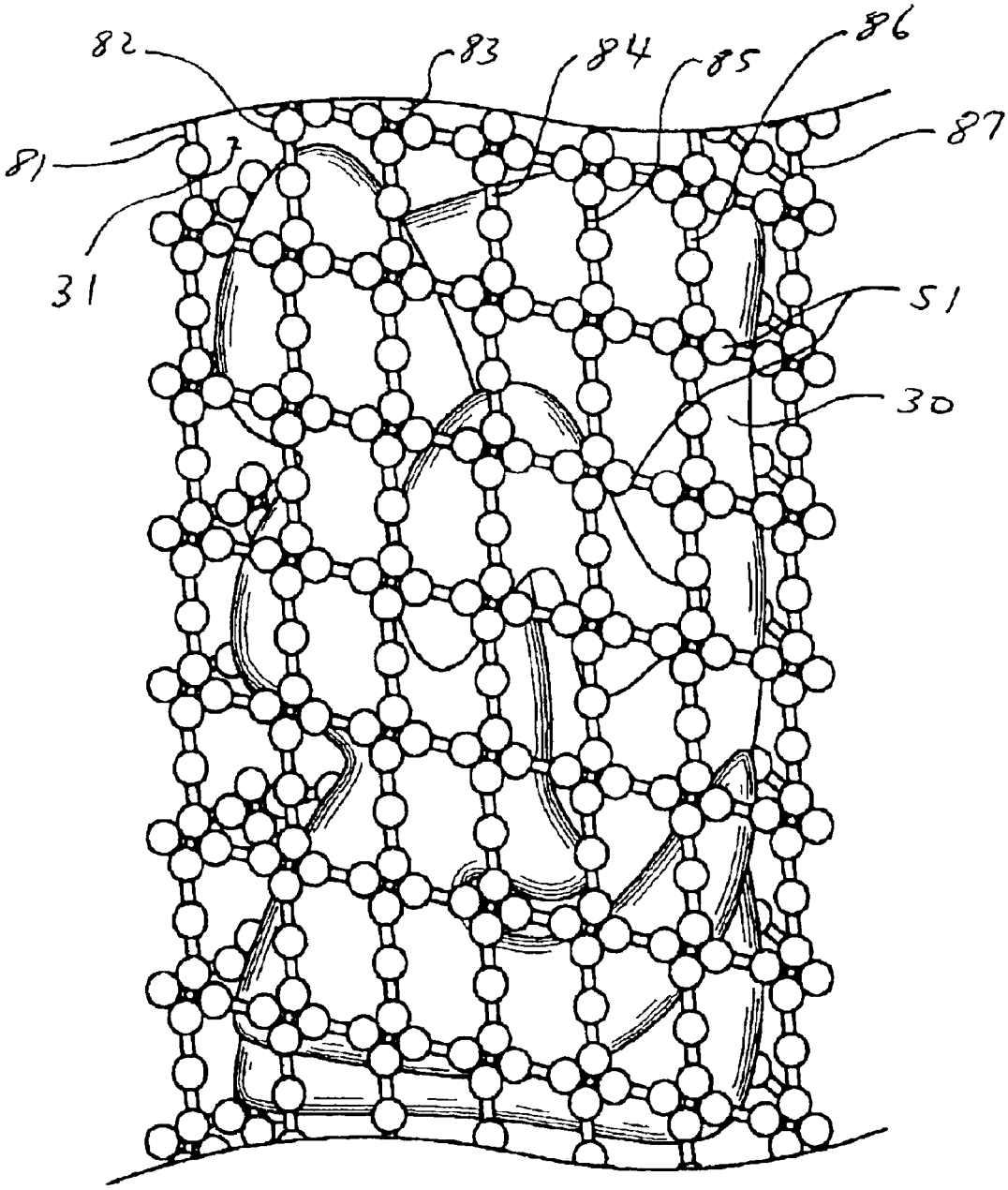
FIG. 1 shows a perspective view of multiple chains of beads connected with a product held inside.

FIG. 1 shows a perspective view of the beads chains shown in FIG. 1 when the beads are connected together in order to create the embodiment which is described herein.

As can be seen in FIGS. 2–4 embodiment the locking chain 51 first goes on either side of first hanging chain 73 then on either side of second hanging chain 74 then on either side of third hanging chain 75 and then it goes back on either side of first hanging chain 73 coming back to either side of second hanging chain 74 before continuing again to go on either side of third hanging chain 75 before coming back to go on either side of strand B again.

FIG. 3 is a view showing the three dimensional nature of the weave area 101 shows the first intersection of four beads which includes a strand 1*a* between two "A" beads in contact with a strand 2*b* passing between two "B" beads. Because of the amount of information that must be disclosed in this drawing, it is not a perspective drawing and for a perspective view of what this intersection would look like, reference is made to FIG. 4 which shows how an "A" strand would interact with a "B" strand as taught in this embodiment.

Area 102 shows the intersection between the strand 2*a* between two "A" beads and a strand 2*c* two "C" beads. Area 103 shows the intersection of an A strand 3*a* with a "D" strand 2*d*. Area 104, the next intersection which is behind 105 shows the intersection (second) of a strand 4*a* between two "A" beads and a strand 4*b* between two "B" beads. Area 105 then shows the second intersection between a strand 5*a* between two A's and a strand 4*c* between two C strands. Area 106 shows the strand 6*a* between two A beads and the strand 4*d* between two D beads and finally the last weave (in this picture) shows the intersection back to the beginning of a strand 7*a* between two A beads and a strand 7*b* between two "B" beads.

As can be seen, this could continue indefinitely. It may also involve more than three hanging strands to number.

Figure 5:
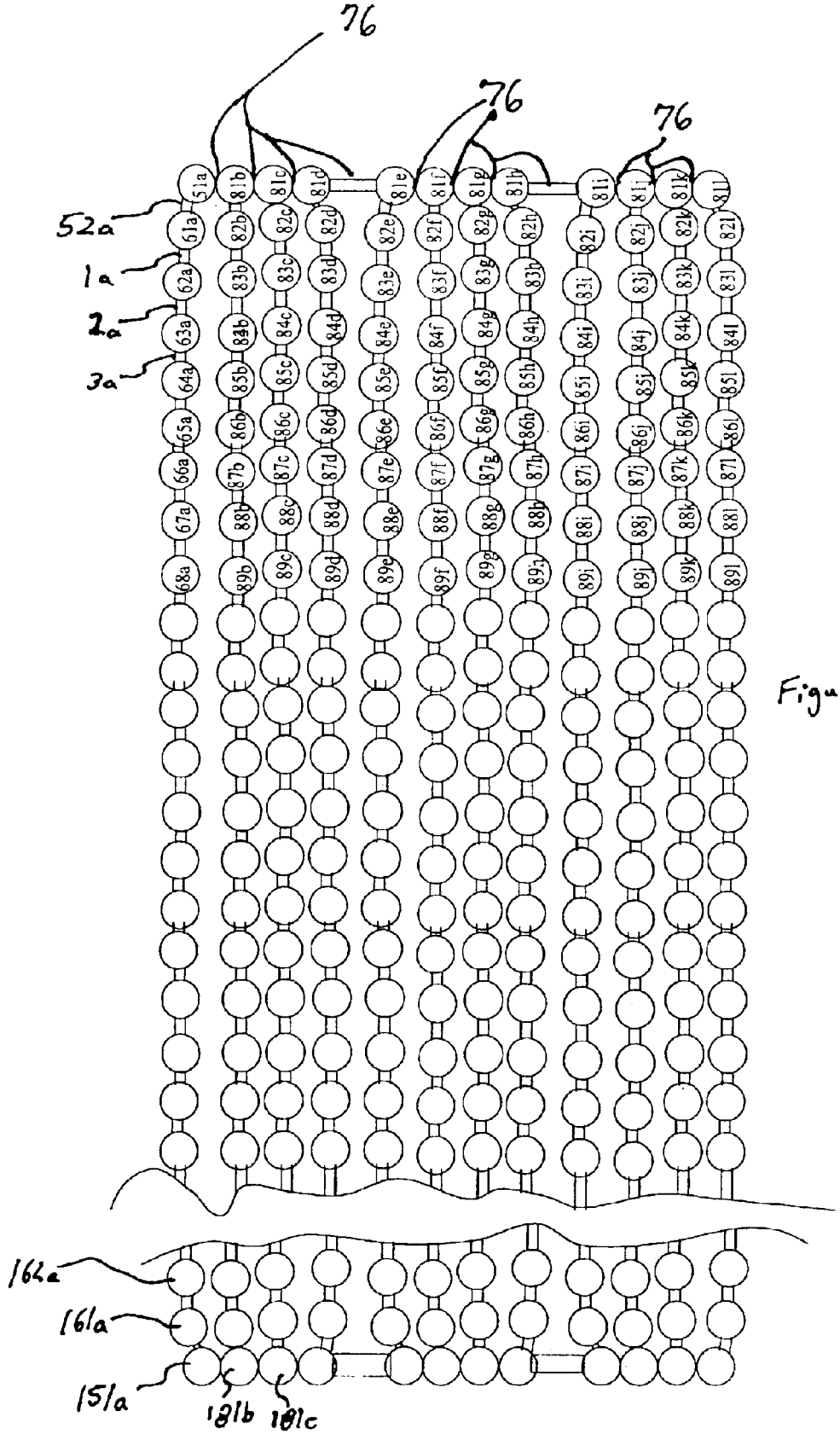
FIG. 5 shows how more chains may be used in the process depicted in FIG. 2.

Likewise, while this shows a weave between chains of A beads, B beads, C beads, and D beads and the number of chains of beads corresponding to the other bead sets allows for the increase indefinitely. FIG. 5 shows an example where there is one locking strand A with eleven other strands which would yield a similar structure although the opening in the middle would be greatly much larger.

In addition to sealing chains at the top, after the weave was completed, the beads from the other end could be sealed together to a corresponding interlock at the bottom of the necklace. Beads along the length could be scaled together.

FIG. 5 shows how a stuffed animal 30 of the same approximate size (or less) as the diameter of the tubular chamber 31 may be held within the chamber 31 formed by the beads or may be woven within the beads prior to the time when the ends are locked together to provide a novel packaging means.

As many stuffed animals as the user desires within the area defined by the weave described herein can be utilized.

Referring to FIG. 1 it can be seen that in operation with a long chain the weave is accomplished by locking chain 51 through all of the hanging chains (81–87 ) the one's in front of or on the edge of the stuffed animal 30 only are shown with each inter-spacial strand from "A" being attached in a manner described in reference to FIG. 4 to every third inter-spacial strand in each of the hanging chains sequentially. It can be seen that the chains 88–92 on the other side of the stuffed animal though not visible in this view would be present forming the other side of the chamber 31. It can be seen that one or more chains may not be hooked, and in that case that chain would either hang inside or outside of the network or cage formed by the other beads. In this way the decoration may be "stuffed" or "contained" with an attached bead.

Referring to FIG. 5, it can be seen that inter-spacial space 51*a* connects to 1*b*, 2*a* to 1*c*, 3*a* to 1*d*, 4*a* to 1*e*, 5*a* to 1*f*, 6*a* to 1*g*, 7*a* to 1*h*, 8*a* to 1*i*, 9*a* to 1*j*, 10*a* to 1*k*, 11*a* to 11. Then the next numbered bead inter-spacial strand 12 contacts with inter-spacial strand 3*b* for a two bead spacing they would sequentially go 12*a* connects to 4*b*, 13*a* to 4*c*, 14*c* to 4*d*, 15*a* to 4*e*, 16*a* to 4*f*, 17*a* to 4*g*, 18*a* to 4*h*, 19*a* to 4*i*, 20*a* to 4*j*, 21*a* to 4*k*, 22*a* to 41. The next numbered bead inter-spacial strand 24*a* contacts the inter-spacial strand 76 connects to 7*c*, 26*a* connects to 7*d*, 27*a* connects to 7*e*, 28*a* connects to 7*f*, 29*a* connects to 7*g*, 30*a* connects to 7*h*, 31*a* connects to 7*i*, 32*a* connects to 7*j*, 33*a* connects to 7*k*. The next numbered bead inter-spacial strand 35*a* connects to 10*b*, 36*a* to 10*c*, 37*a* to 10*d*, 38*a* to 10*e*, 39*a* to 10*f*, 40*a* to 10*g*, 41*a* to 10*h*, 42*a* to 10*i*, 43*a* to 10*j*, 44*a* to 40*k*, 45*a* to 101, 46*a* to 13*g*. The next inter-spacial strand 46*a* contacts the inter-spacial strand 46*a* connects to 13*d*, 47*a* to 13*e*, 48 to 13*f*, 49 to 13*g*, 50 to 13*h*, 51 to 13*i*, 52 to 13*j*, 53 to 13*k*, 54 to 131, 55 to 16*b*. 56 to 16*c*, 57 to 16*d*, and so on until the entire chains are connected and the entire cage is made here with out leaving out one or more strands to hang either inside or outside of the cage form thereby created according to the design desired by the user. By skipping chains (e.g. j, k and 1, hanging beads inside, outside or both or weaves inside, outside or both from the chamber may be created.

Referring back to FIG. 3, it can be seen that the bead sets (chains) involved in each of the weaves can be numbered for the initial strand here 101, 102, 103, 104, 105, 106, and 107, and this would continue on as the beads were interwoven to make the complete mesh.

The process does allow that stuffed toys with extremities may have the body of the toy within the chamber and the extremities may stick between openings 39 in the weave outside of the chamber. Alternatively, the weave or other wrap may be used to hide in whole or in part the toy which may also be wrapped to further disguise it.

Figure 7:
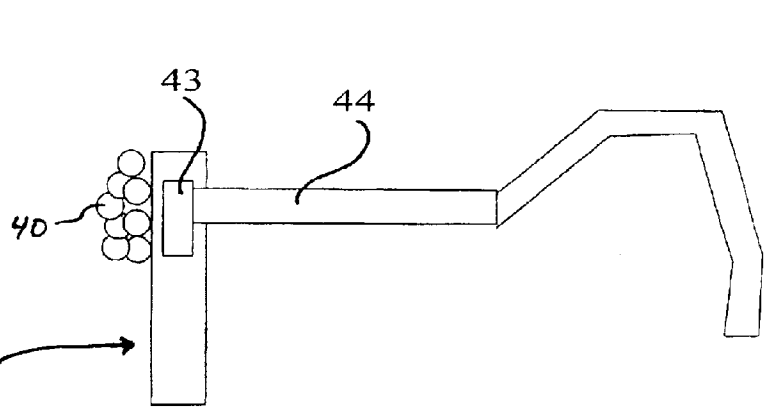
FIG. 7 shows a side view of the embodiment shown in FIG. 6.
Figure 6:
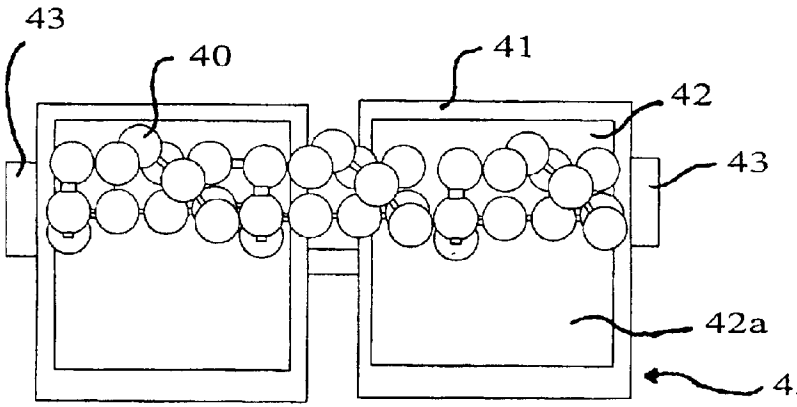
FIG. 6 shows a front view of a pair of glasses equipped with a decorative completed bead weave.

This can best be seen by reference to FIG. 6 and FIG. 7, the device can be used to decorate other items, in this case a pair of glasses 45 comprised of a frame 41, a lens 42, a two leg holding brackets on either side of the frame 41, said brackets 43 each holding one of the legs 44 for fitting over the users ear. A portion of the lens is parochially obscured by the completed weave 40 and a part of the lens 42 A is left completely clear.

In this way the woven bead product provides both decoration and a partial shade over the front of the sunglasses 45.

As can best be seen in reference to FIG. 5, the last beads in this case numbered 151*a* for the last bead of the chain starting with 51*a*, 181*b* for the last bead of the string starting with 81*b*, 181*c* for the last bead ending string starting with bead 81*c*, etc., would also be part of the weave but would not be locked together until after the weave was completed in most cases because of the complexity of weaving the beads with them locked together on both ends.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

I claim:

1. A method of making cylindrical chambers having a framework of beads and strands from at least three chains comprising a locking chain and at least two hanging chains; each of said chains comprised of a plurality of beads separated by spaces defined by the inter-spacial strands along the chain of a length less than the diameter of the beads comprising the steps of:

A. weaving the locking chain of beads sequentially in contact with each of the at least two hanging chains;

B. Repeating step A until the desired length as obtained.

2. The method of claim 1 further comprising locking the first beads of each chain together where the chamber begins.

3. The method of claim 1 further comprising locking the last beads of the chamber together.

4. The method of claim 1 wherein the steps of weaving further comprises frictionally locking at least a second plurality of the beads of the locking chain to at least a second plurality of the beads in the hanging strand.

5. The method of claim 4 further comprising the step of maintaining tension in the weave on the locking chain.

6. The method of the claim 5 wherein step of maintaining tension further comprises skipping at least two strands on the hanging chains and skipping at least one less strand on the connecting chain.

7. The method of the claim 6 wherein the step of locking consists attaching across every strand of the locking chain and at no more than every other strand of the hanging chains.

8. The method of claim 7 wherein locking comprising attaching across every third strand of the hanging chains.

9. The method of claim 1 wherein the weave further comprises front beads and last beads and the step of connecting further comprises connecting the first beads to the last beads to form a loop.

10. The method of claim 1 further comprising the step of attaching the chains to an object to decorate the object.

11. A product comprised of at least one locking bead chain comprised of a plurality of beads connected by strands; a plurality of hanging chains comprised of a plurality of beads connected by strands; a connecting means for connecting a second plurality of beads in the locking chain to a connecting means further comprises a connecting means for sequentially connecting the locking chain to the plurality of hanging chains in a helix.

12. The product of claim 11 wherein the connecting means connects at least ten strands of the locking chain across at least ten strands of the at least three hanging chains.

13. The product of claim 12 further comprising a chamber formed by the hanging chains and connecting chain.

14. The product of claim 13 further comprising at least one object held within the chamber.

15. The product of claim 11 wherein the connecting means further comprises a frictional lock means.

16. The product of claim 15 further comprising a glue means to further secure the frictional lock means.

17. The product of claim 16 wherein the beads are wider in diameter than the strands and wherein the friction lock is obtained by pressing beads on either side of the strand in the locking chain sequentially across a strand between two beads of a hanging chain and wherein each of the chains further comprises at least two beads on either side of the strand.

18. The product of claim 17 further comprises a tensioning means for applying tension across the locking chain.

19. The product of claim 18 wherein the tensioning means further comprises tightly attaching each strand of the locking chain across at least every other strand of the plurality of hanging chains.

* * * * *